US008460036B1

(12) United States Patent
Chen

(10) Patent No.: US 8,460,036 B1
(45) Date of Patent: Jun. 11, 2013

(54) ELECTRICAL CONNECTOR

(75) Inventor: Po-Jung Chen, Taoyuan (TW)

(73) Assignee: U.D. Electronic Corp., Taoyuan (TW)

( * ) Notice: Subject to any disclaimer, the term of this patent is extended or adjusted under 35 U.S.C. 154(b) by 0 days.

(21) Appl. No.: 13/372,633

(22) Filed: Feb. 14, 2012

(51) Int. Cl.
*H01R 24/00* (2011.01)

(52) U.S. Cl.
USPC ..... 439/660; 439/76.1

(58) Field of Classification Search
USPC ..... 439/607.35, 607.4, 76.1, 660
See application file for complete search history.

(56) References Cited

U.S. PATENT DOCUMENTS 7,618,293 B2 * 11/2009 Wu ..... 439/660
7,837,499 B1 * 11/2010 Chen ..... 439/541.5
7,927,145 B1 * 4/2011 Chang ..... 439/607.31
8,066,532 B2 * 11/2011 Hou et al. ..... 439/660
8,113,882 B1 * 2/2012 Chen ..... 439/607.01
2010/0203751 A1 * 8/2010 Tsai ..... 439/222
2011/0269322 A1 * 11/2011 He et al. ..... 439/78
2012/0115362 A1 * 5/2012 Zhang ..... 439/607.35

* cited by examiner

*Primary Examiner* — James Harvey
(74) *Attorney, Agent, or Firm* — Bacon & Thomas, PLLC

(57) ABSTRACT

An electrical connector includes an electrically insulative holder member, a signal module formed of a circuit board with recessed holes, circuit lines, electrical contacts and via-holes and metal contact terminals and metal mounting terminals, and a metal shield. The metal contact terminals have rear soldering end portions thereof respectively soldered to respective circuit lines, front contact portions thereof positioned in front ends of the recessed holes of the circuit board and middle suspension arms thereof connected between the rear soldering end portions and the front contact portions below the recessed holes and elastically deformable to prevent damage. The circuit lines electrically connect the 5 pcs of electrical contacts and the 4 pcs of metal contact terminals to the 9 pcs of via-holes. The surface area of each circuit line may be modified to adjust impedance for reducing interference.

9 Claims, 9 Drawing Sheets

ELECTRICAL CONNECTOR

BACKGROUND OF THE INVENTION

1. Field of the Invention

The present invention relates to electrical connector technology and more particularly, to such an electrical connector, which achieves optimal impedance matching and high structural stability, ensuring high signal transmission quality and reliability.

2. Description of the Related Art

Following fast development of computer technology, high mobility notebook computer has been well developed and widely used by people to substitute for desk computer. Further, when connecting a computer to a peripheral apparatus for transmitting data or signal, a peripheral interface means is necessary. USB (universal serial bus) is the mainstream interface, having hot plug function. However, USB 2.0 is simply applicable to peripheral devices (such as, card reader, printer, memory stick, web-phone, webcam, and etc.) that have the characteristics of low driving power and low transmission speed, not suitable for use in a high storage capacity hard disk drive, DVD programmer or player, or blue-light peripheral device. For high-power and high-speed application, USB 3.0 (USB super-speed) is created. A USB 3.0 connector has a transmission speed as high as 4.8 Gbps, and is compatible with USB 2.0. Further, a USB 3.0 connector supports full duplex and provides up to 900 mA power output. Thus, by means of the application of an USB 3.0 connector, a high storage capacity hard disk drive does not require an extra power cable. The application of USB 3.0 technology allows interruption under standby mode, reducing power loss and providing maximum user flexibility and efficiency.

Further, following the market trend to make computers and peripheral devices having a small size characteristic, the problem of internal signal interference due to magnetic effects must be taken into account. Interferences may come from conducted disturbance that occurs during signal transmission through power circuits and/or signal lines of the circuit board to the electrical connector, or radiated disturbance that occurs due to the radiation of magnetic waves around the electrical connector. As a USB 3.0 connector uses a large number of conducting terminals that are arranged in a limited mounting area, approaching between two conducting terminals or curving of any conducting terminal may cause disturbance (static interference, electromagnetic interference, impedance matching, noise interface, crosstalk interference) during the transmission of a high-frequency signal. Further, EMI (electromagnetic interference) and noises can be eliminated or reduced during signal transmission between a USB 3.0 connector and a system mainboard interface only if impedance matching condition is satisfied. Improper impedance matching can cause signal reflection and noise interference, resulting in signal loss, signal deformation and/or signal distortion. When this problem occurs, the electronic system (computer or network system) may be unable to function normally.

Further, a circuit board design of tongue plate has copper foil contacts arranged on a plane. For example, an HDMI socket connector is based on this design. Further, a circuit board design of tongue plate for USB 3.0 female connector has 5 pcs of copper foil contacts and 4 pcs of springy metal contact terminals. When a USB 3.0 male connector is inserted into a USB 3.0 female connector, the arrangement of the springy metal contact terminals at the circuit board design of tongue plate of the USB 3.0 female connector may causes serious mechanism problems. One first problem is that the positioning of the front contact portions of the springy metal contact terminals on the top side of the circuit board design of tongue plate may be directly impacted by the mating metal contact terminals of the USB 3.0 male connector, due to positioning displacement or large tolerance, causing disconnection of the spring metal contact terminals from the circuit board design of tongue plate. A second problem is that the springy metal contact terminals may be squeezed toward the circuit board design of tongue plate by a lateral force upon insertion of the USB 3.0 male connector into the USB 3.0 female connector, causing damage or disconnection of the rear soldering portions of the springy metal contact terminals from the circuit board design of tongue plate. A third problem is that the circuit board design of tongue plate has no room for allowing the springy metal contact terminals to elastically and heavily deform, and the springy metal contact terminals may be permanently deformed.

Therefore, it is desirable to provide an electrical connector, which eliminates the aforesaid problems.

SUMMARY OF THE INVENTION

The present invention has been accomplished under the circumstances in view. It is therefore the main object of the present invention to provide an electrical connector, which achieves optimal impedance matching and high structural stability, ensuring high signal transmission quality and reliability.

To achieve this and other objects of the present invention, an electrical connector comprises an electrically insulative holder member, a signal module mounted in the holder member, and a metal shield surrounding the holder member and the signal module. The signal module comprises a circuit board, which comprises a plurality of recessed holes, a plurality of circuit lines, a plurality of electrical contacts and a plurality of via-holes, a plurality of metal contact terminals respectively mounted on the circuit board corresponding to the recessed holes, each metal contact terminal comprising a rear soldering end portion electrically soldered to one circuit line, a front contact portion respectively positioned in a front end of one recessed hole and a suspension arm obliquely downwardly extending from the rear soldering end portion and terminating in the front contact portion below the associating recessed hole, and a plurality of metal mounting terminals respectively soldered to the via-holes of the circuit board and inserted through respective through holes of the holder base.

Further, the surface area of the circuit lines of the circuit board may be configured subject to different impedance matching requirements, enhancing signal transmission quality and reliability.

Further, an electronic component, such as common-mode choke coil, filter resistor or filter capacitor may be installed in the circuit lines for removing noises.

DETAILED DESCRIPTION OF THE PREFERRED EMBODIMENT

Figure 1:
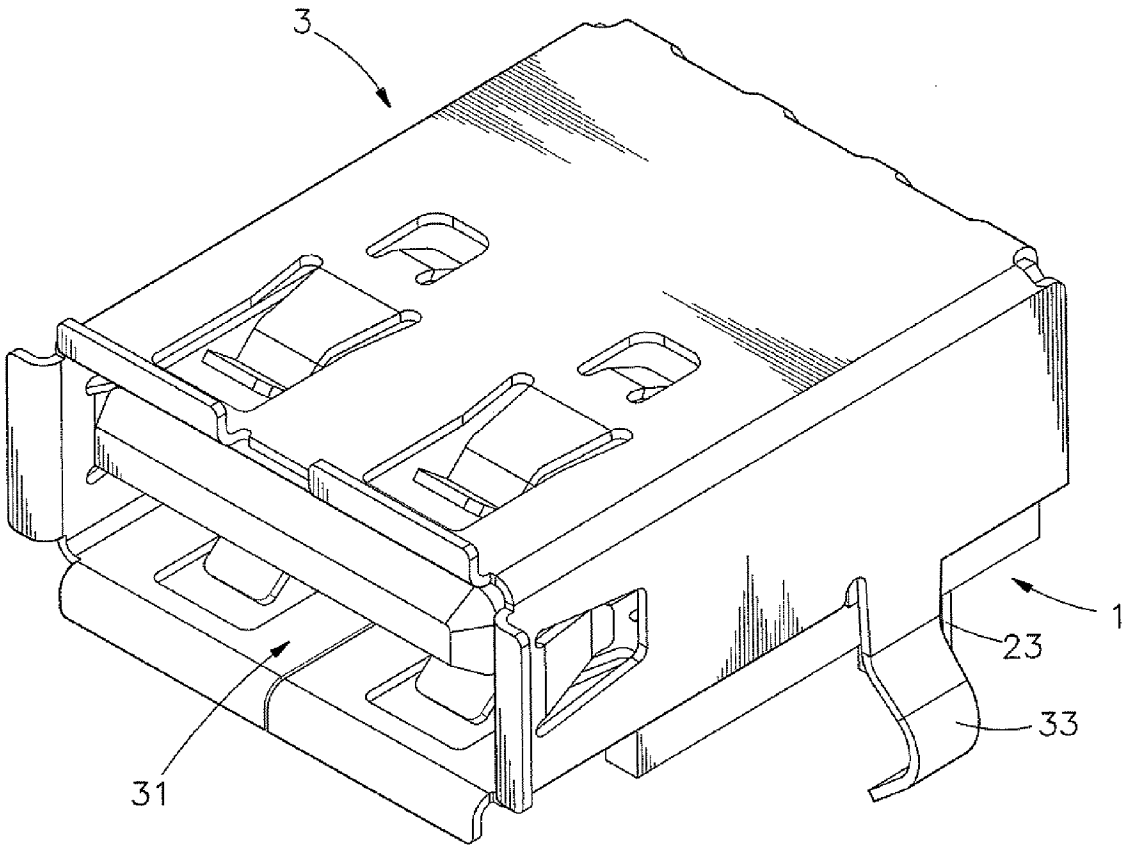
FIG. 1 is an oblique top elevational view of an electrical connector in accordance with the present invention.
Figure 2:
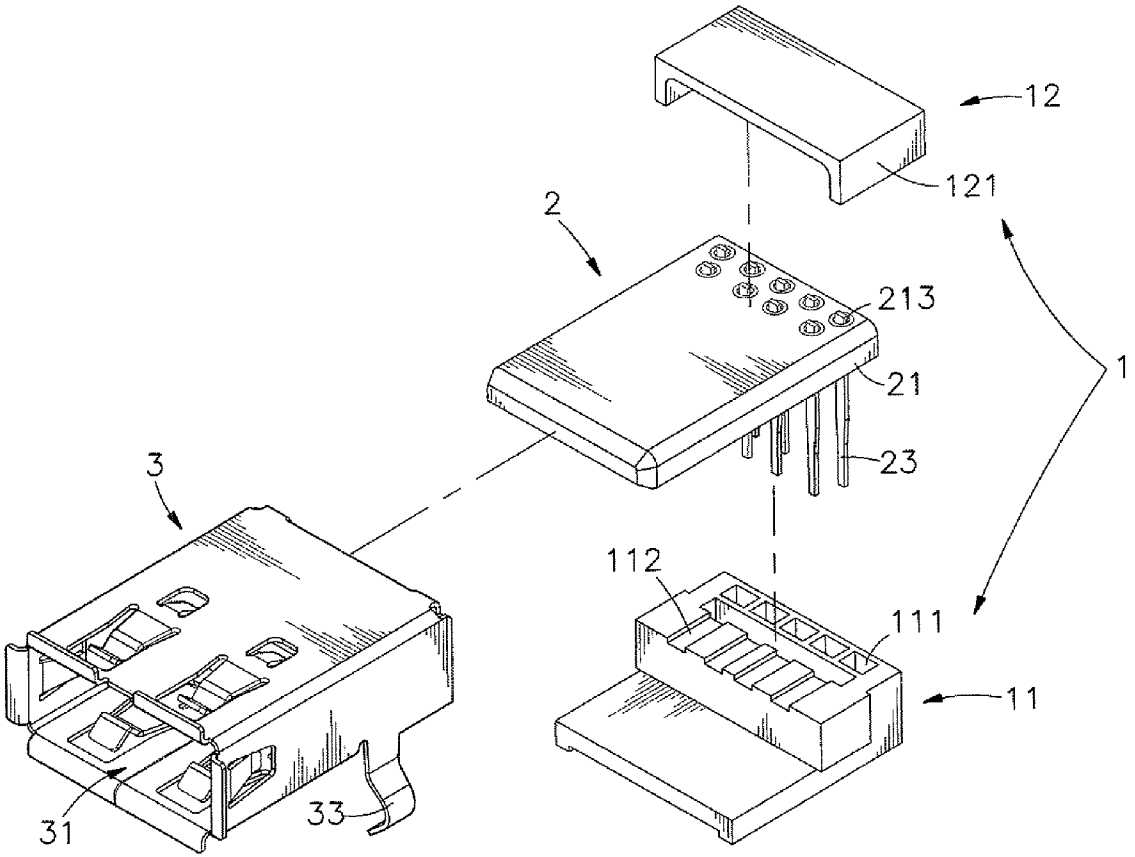
FIG. 2 is an exploded view of the electrical connector in accordance with the present invention.
Figure 3:
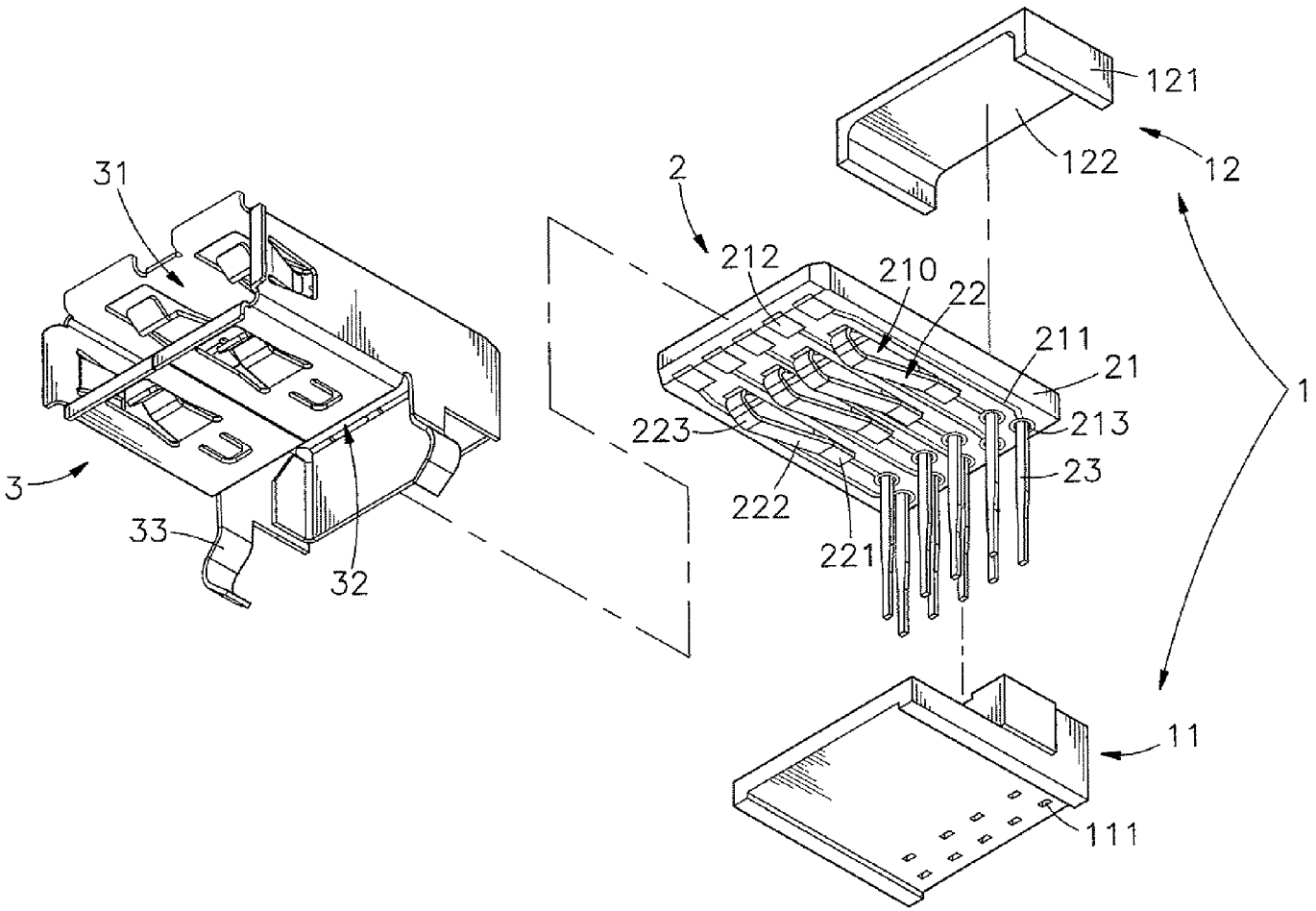
FIG. 3 corresponds to FIG. 2 when viewed from another angle.
Figure 4:
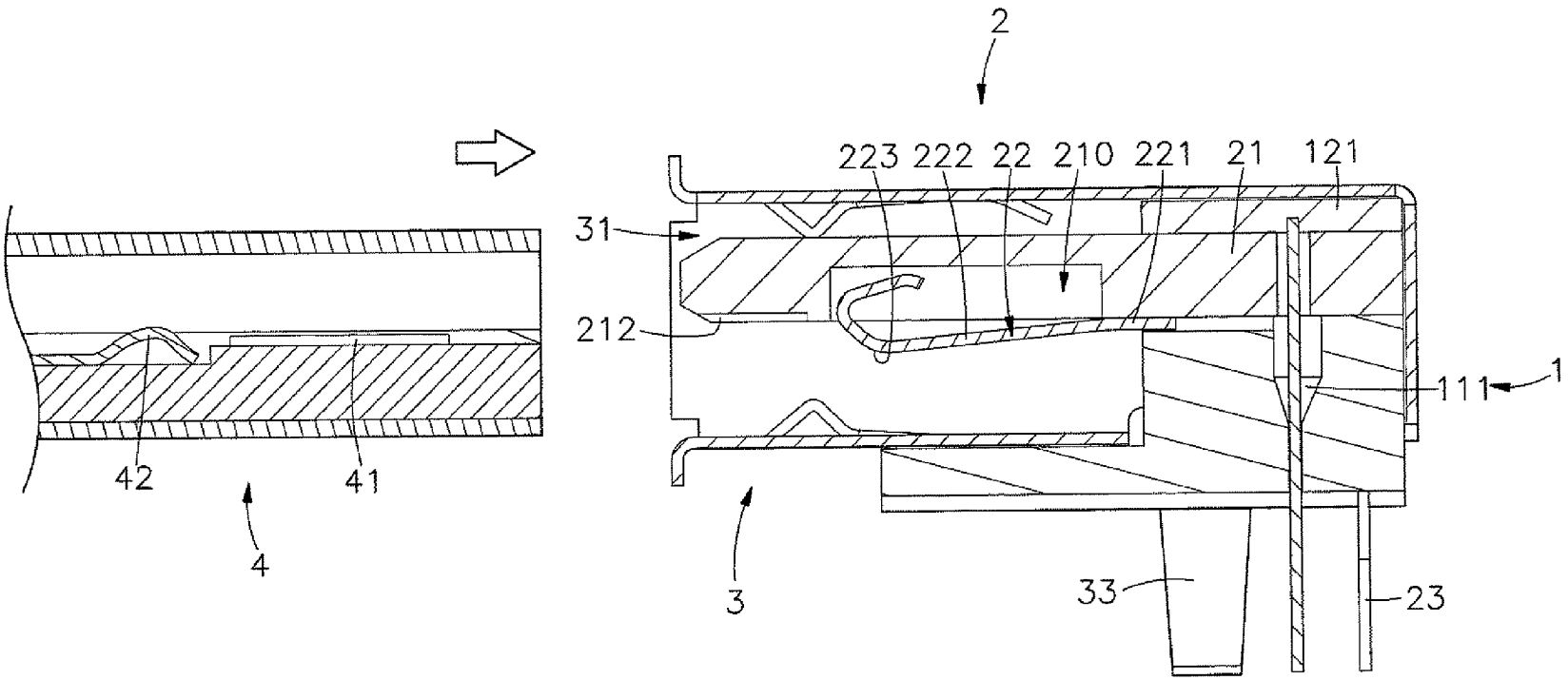
FIG. 4 is a sectional applied view of the present invention before insertion of a mating electrical connector.

Reference will be made in detail to the preferred embodiment of the invention, an example of which is illustrated in the accompanying drawings. Wherever possible, like reference numbers are used in the drawings and the description to refer to like parts.

Referring to FIGS. 1, 2, 3 and 4, an elevational view, an exploded view, an exploded view viewed from another angle and a sectional side view in an enlarged scale of an electrical connector (USB female connector) in accordance with the present invention are respectively shown. The electrical connector comprises an electrically insulative holder member 1, a signal module 2, and a metal shield 3.

The electrically insulative holder member 1 comprises a holder base 11 having a plurality of vertically extending through holes 111 and a plurality of horizontally extending terminal grooves 112, and a cover plate 12 covered on the holder base 11 over the through holes 111. The cover plate 12 is a substantially inverted U-shaped plate member having two sidewalls 121 respectively perpendicularly extended from two opposite lateral sides thereof in a parallel manner and defining therebetween a bottom open chamber 122.

The signal module 2 comprises a horizontally extending circuit board 21, a plurality of metal contact terminals 22, and a plurality of metal mounting terminals 23. The circuit board 21 defines a plurality of longitudinally extending recessed holes 210, a plurality of circuit lines 211, a plurality of electrical contacts 212, and a plurality of via-holes 213. The metal contact terminals 22 are respectively set in the recessed holes 210 of the circuit board 21, each comprising a rear soldering end portion 221 electrically soldered to one respective circuit line 211 at the circuit board 21, a front contact portion 223 respectively positioned in the front end of one respective recessed hole 210, and a suspension arm 222 obliquely downwardly extending from the rear soldering end portion 221 and terminating in the front contact portion 223 below the recessed hole 210. According to this embodiment, the metal contact terminals 22 are configured subject to USB 2.0 specification, i.e., the number of the metal contact terminals 22 is 4; the electrical contacts 212 are configured to match with the metal contact terminals 22 subject to USB 3.0 specification, i.e., the number of the electrical contacts 212 is 5; the electrical contacts 212 and the front contact portion 223 are respectively arranged in a respective line in a staggered manner. Further, the metal contact terminals 22 and the electrical contacts 212 are respectively electrically connected to the via-holes 213 by the circuit lines 211. The metal mounting terminals 23 are respectively soldered to the via-holes 213 and vertically downwardly extended from the circuit board 2.

Further, the rear soldering end portions 221 of the metal contact terminals 22 and the metal mounting terminals 23 are respectively soldered to the via-holes 213 by SMT (surface mounting technology) and through-hole technology. However, this mounting arrangement is not a limitation. SMT (surface mounting technology) and through-hole technology may be selectively employed to solder the rear soldering end portions 221 of the metal contact terminals 22 and the metal mounting terminals 23 to the via-holes 213 subject to different design requirements. Further, the circuit board 21 can be a single layer board, or multi-layer board.

The metal shield 3 comprises a front receiving hole 31, a rear accommodation chamber 32 disposed in communication with the front receiving hole 31, and two bottom mounting legs 33 respectively downwardly extended from two opposite lateral sides thereof.

Referring to FIGS. 1-4 again, during installation of the electrical connector, solder the rear soldering end portions 221 of the metal contact terminals 22 and the metal mounting terminals 23 to the respective circuit line 211 and the via-holes 213 of the circuit board 21 respectively, and then insert the metal mounting terminals 23 through the respective through holes 111 of the holder base 11 of the electrically insulative holder member 1 to force the rear soldering end portions 221 of the metal contact terminals 22 into the terminal grooves 112 of the holder base 11 of the electrically insulative holder member 1, and then attach the sidewalls 121 of the cover plate 12 to the holder base 11 to keep the circuit board 21 in the bottom open chamber 122 of the cover plate 12, and then wrap the metal shield 3 about the electrically insulative holder member 1 and the signal module 2 to have the electrically insulative holder member 1 be positioned in the rear accommodation chamber 32 of the metal shield 3 and the circuit board 21 be positioned in the front receiving hole 31. Thus, the 5 pcs of electrical contacts 212 are disposed near the front side of the circuit board 21; the metal contact terminals 22 are spaced behind the electrical contacts 212 in a staggered manner; the circuit lines 211 respectively electrically connect the electrical contacts 212 and the metal contact terminals 22 to the 9 pcs of via-holes 213.

Figure 5:
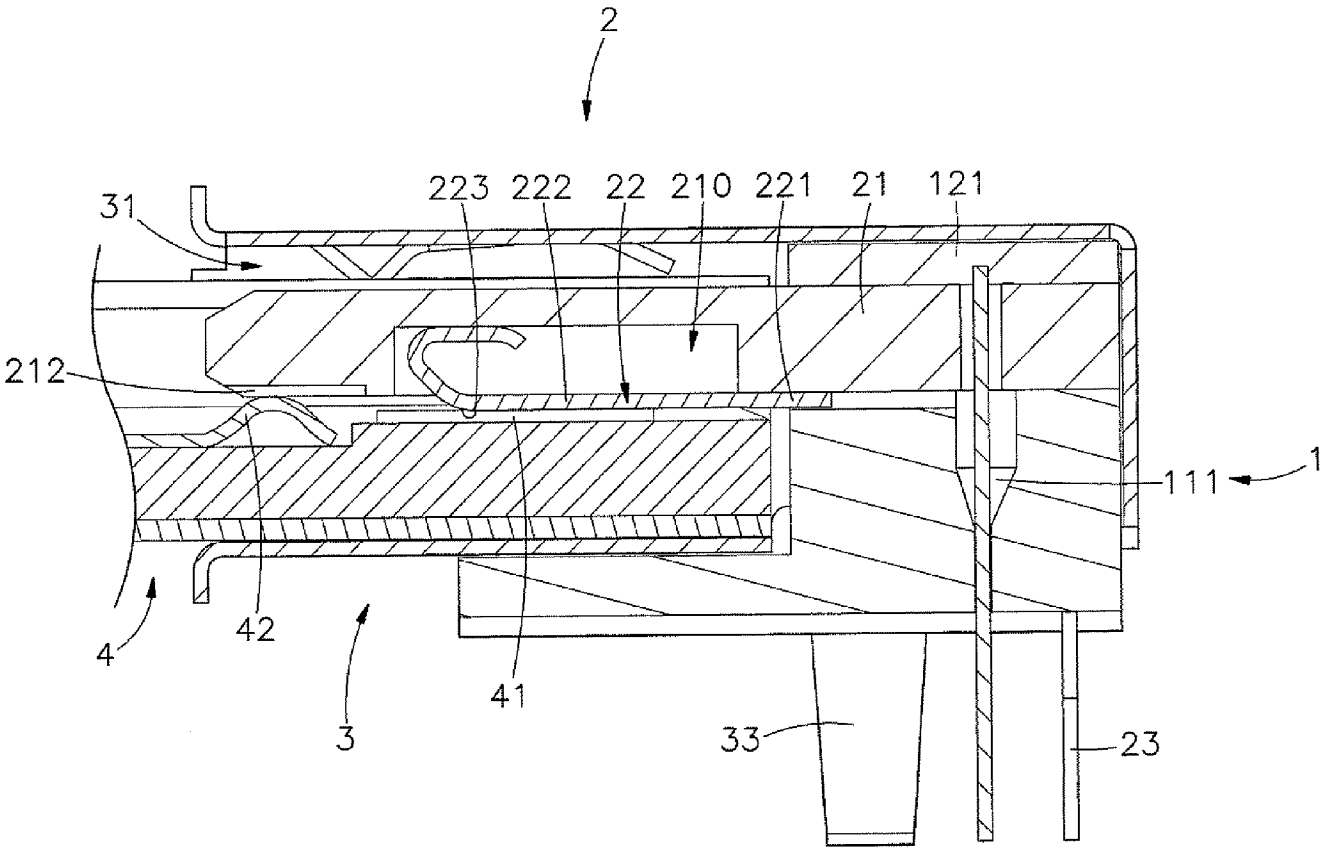
FIG. 5 corresponds to FIG. 4, illustrating the mating electrical connector inserted into the front receiving hole of the metal shield and electrically connected to the signal module.

Referring to FIG. 5 and FIGS. 2-3 again, when using the electrical connector, a mating (USB male) connector 4 is inserted into the front receiving hole 31 of the metal shield 3, internal front flat terminals 41 and rear conducting terminals 42 of the mating (USB male) connector 4 are respectively forced into contact with the metal contact terminals 22 and the electrical contacts 212 of the signal module 2. When moving the front flat terminals 41 toward the metal contact terminals 22, the front contact portions 223 will be forced by the front flat terminals 41 against the respective suspension arms 222 and rear soldering end portions 221, causing the respective front contact portions 223 and suspension arms 222 to curve toward the respective recessed holes 210. Subject to the design of the recessed holes 210, the front contact portions 223 can have a relatively greater deformation stroke in vertical direction. Further, as the rear soldering end portions 221 are firmly secured between the bottom wall of the circuit board 21 and the terminal grooves 112 of the holder base 11 of the electrically insulative holder member 1, inserting the mating (USB male) connector 4 into the front receiving hole 31 of the metal shield 3 will not excessively deform or damage the metal contact terminals 22. Thus, the design of the invention facilitates installation and assures high reliability.

Referring to FIG. 3 again, as stated above, the signal module 2 comprises 5 pcs of electrical contacts 212 and 4 pcs of metal contact terminals 22. The electrical contact 212 at the midpoint is for grounding. The other 4 pcs of electrical contacts 212 that are symmetrically disposed at two opposite lateral sides are for signal transmission. The left and right-sided metal contact terminals 22 are the power terminal and the grounding terminal. The other two metal contact terminals 22 on the middle are for signal transmission. Thus, during transmission of high-frequency signal through the respective signal-transmission electrical contacts 212 and signal-transmission metal contact terminals 22, the grounding electrical contact 212 and the respective grounding circuit line 211 guide electromagnetic waves to the respective grounding metal mounting terminal 23 for discharge, eliminating or reducing EMI (electromagnetic interference) and/or cross talk.

Figure 6:
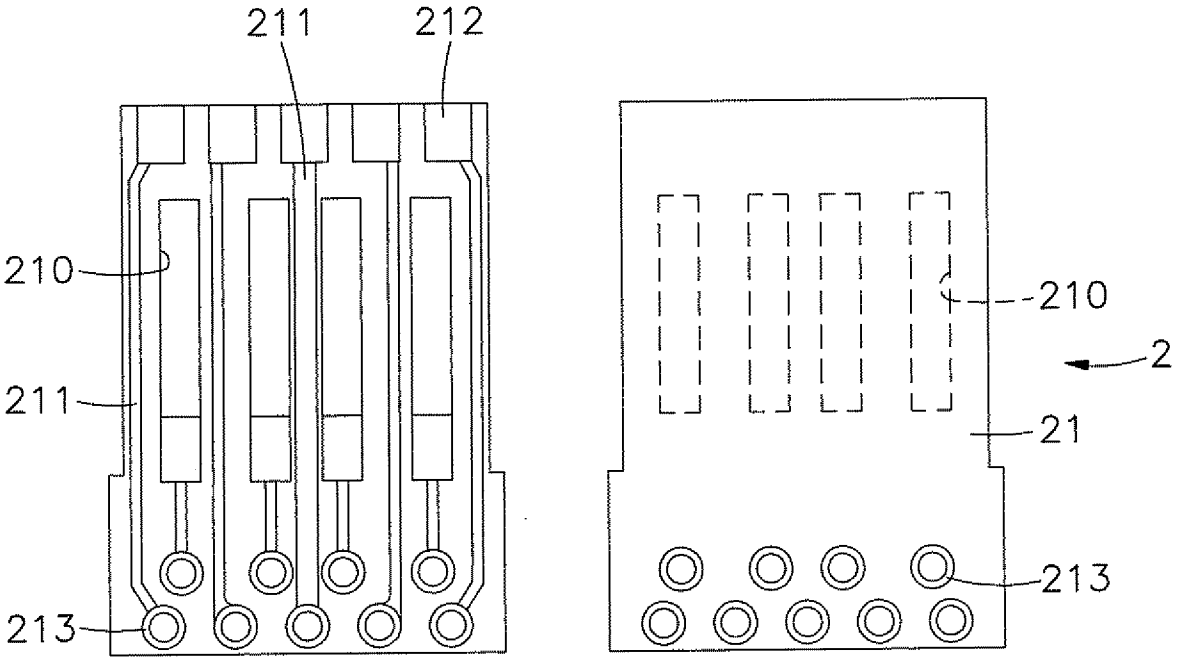
FIG. 6 is a schematic plain view illustrating an alternate form of the circuit board of the electrical connector in accordance with the present invention.

Referring to FIG. 6, the circuit line 211 on the middle for grounding may be made having a relatively large width to increase the surface area for interference elimination, enhancing signal transmission quality and reliability.

Figure 7:
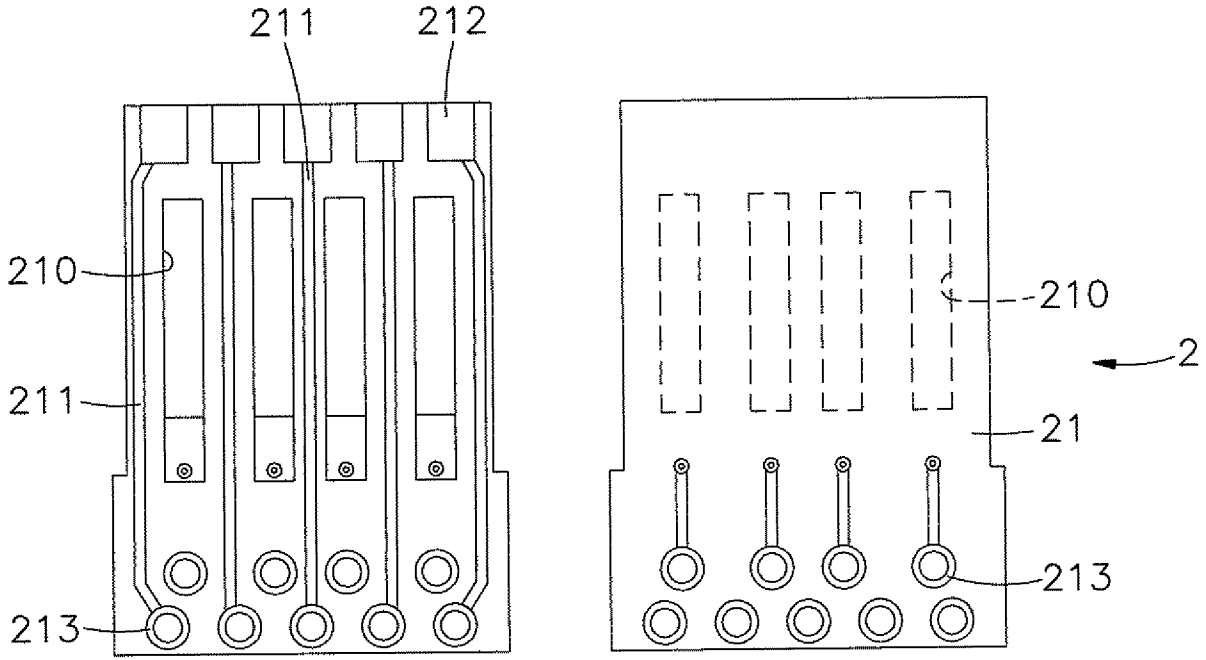
FIG. 7 is a schematic plain view illustrating another alternate form of the circuit board of the electrical connector in accordance with the present invention.

FIG. 7 illustrates another alternate form of the present invention. According to this embodiment, the circuit lines 211 are respectively arranged on opposing top and bottom sides of the circuit board 21.

Figure 8:
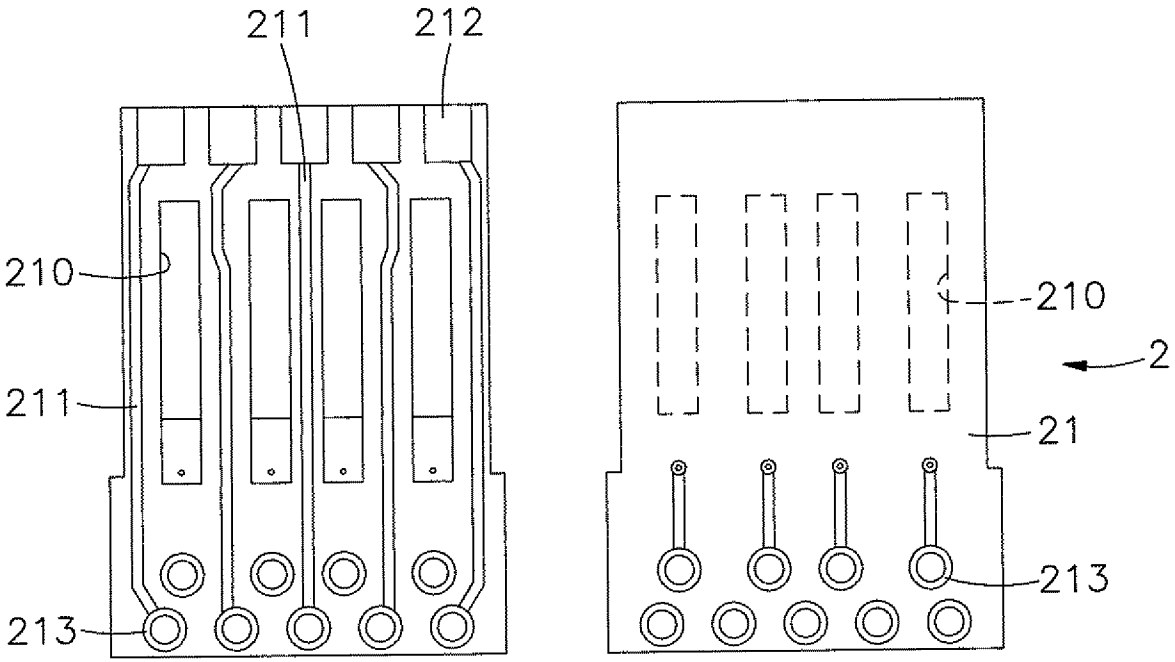
FIG. 8 is a schematic plain view illustrating still another alternate form of the circuit board of the electrical connector in accordance with the present invention.

Further, a USB 3.0 connector must match the impedance (Z) of the system mainboard interface. EMI and noises can be eliminated or reduced for allowing accurate signal transmission between the USB 3.0 connector and the system mainboard interface only if impedance matching condition is satisfied. FIG. 8 illustrates still another alternate form of the present invention. According to this embodiment, each pair of circuit lines 211 for signal transmission has the same length to achieve impedance matching. Thus, each pair of circuit lines 211 for signal transmission can be made having a predetermined surface area and length subject to impedance matching requirements, achieving optimal impedance matching.

Figure 9:
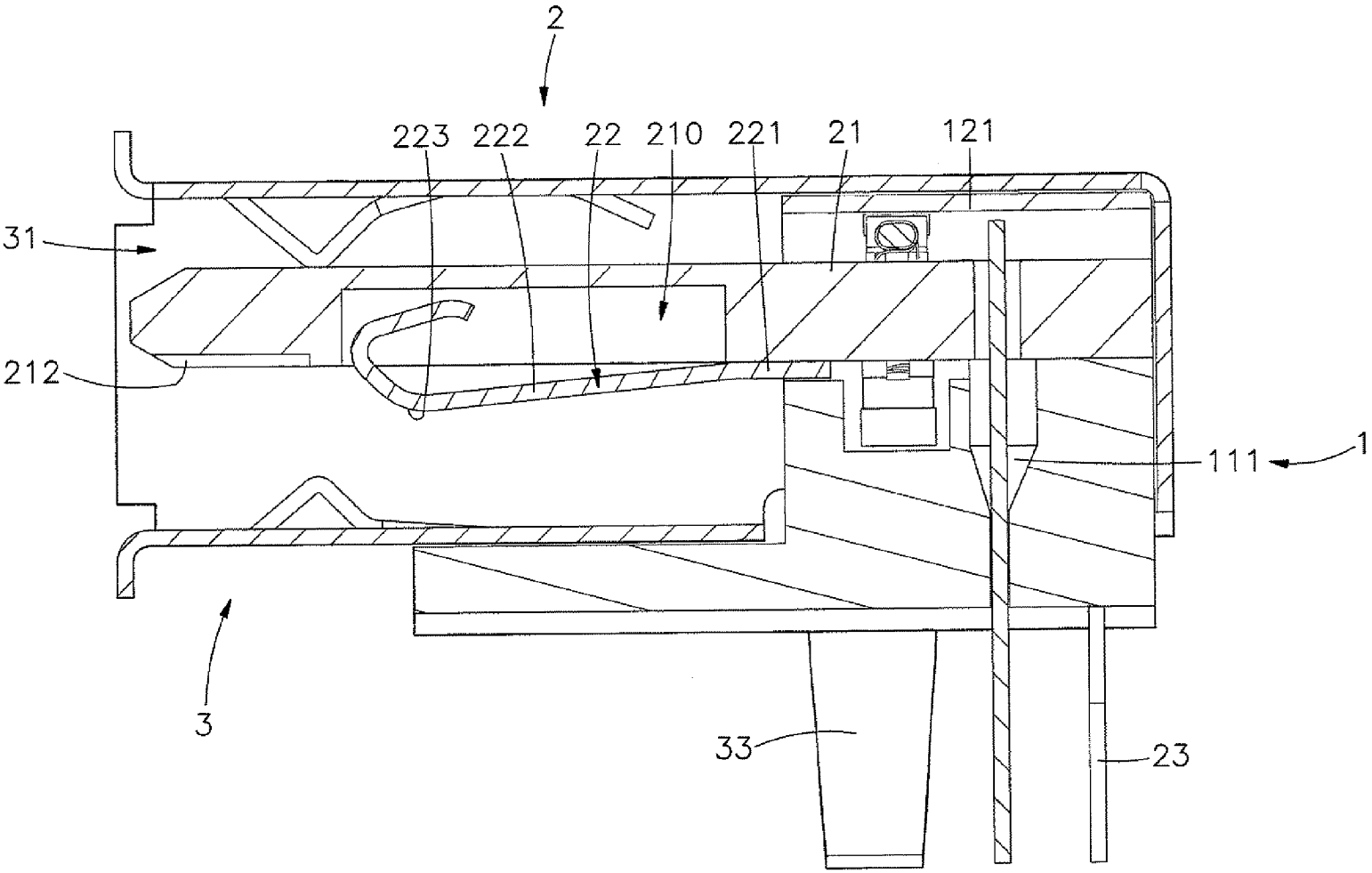
FIG. 9 is a schematic sectional view illustrating still another alternate form of the electrical connector in accordance with the present invention.

FIG. 9 illustrates still another alternate form of the present invention. According to this embodiment, an electronic component, such as CMC coil (common-mode choke coil), resistor or capacitor, filter resistor or filter capacitor may be installed in the circuit lines 211 of the circuit board 21 for removing noises and electromagnetic waves, enhancing signal transmission quality and reliability.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An electrical connector, comprising:

an electrically insulative holder member comprising a holder base having a plurality of vertically extending through holes;

a signal module comprising a circuit board horizontally supported on said holder base of said electrically insulative holder member, said circuit board comprising a plurality of recessed holes, a plurality of circuit lines, a plurality of electrical contacts and a plurality of via-holes, a plurality of metal contact terminals respectively mounted on said circuit board corresponding to said recessed holes, each said metal contact terminal comprising a rear soldering end portion electrically soldered to one said circuit line, a front contact portion respectively positioned in a front end of one said recessed holes and a suspension arm obliquely downwardly extending from said rear soldering end portion and terminating in said front contact portion below the associating recessed hole, and a plurality of metal mounting terminals respectively soldered to said via-holes of said circuit board and inserted through the through holes of said holder base, said metal contact terminals being configured subject to USB 2.0 specification, said electrical contacts being configured to match with said metal contact terminals subject to USB 3.0 specification, said electrical contacts and the front contact portion of said metal contact terminals being respectively arranged in a respective line in a staggered manner, said circuit lines electrically connecting said metal contact terminals and, said electrical contacts to said via-holes respectively; and a metal shield surrounding said electrically insulative holder member and said signal module, said metal shield comprising a front receiving hole that accommodates said electrically insulative holder member, and a rear accommodation chamber that accommodates said signal module.

2. The electrical connector as claimed in claim 1, wherein said electrically insulative holder member further comprises a cover plate capped on said holder base over said via-holes of said circuit board, said cover plate comprising two sidewalls respectively perpendicularly extended from two opposite lateral sides thereof, and a bottom open chamber defined between said two sidewalls.

3. The electrical connector as claimed in claim 1, wherein said metal shield further comprises two mounting legs respectively downwardly extended from two opposite lateral sides thereof.

4. The electrical connector as claimed in claim 1, wherein said circuit board of said signal module further comprises an electronic component installed in said circuit lines for removing noises.

5. The electrical connector as claimed in claim 4, wherein said electronic component is a common-mode choke coil.

6. The electrical connector as claimed in claim 1, wherein said electronic component is a filter capacitor.

7. The electrical connector as claimed in claim 1, wherein said electronic component is a filter resistor.

8. The electrical connector as claimed in claim 1, wherein the circuit lines of said circuit board for signal transmission are arranged in pairs, each pair of circuit lines has the same length.

9. The electrical connector as claimed in claim 1, wherein one middle circuit line of said circuit lines of said circuit board is adapted for grounding and has a surface area relatively larger than the other said circuit lines.

* * * * *